US010378358B2

(12) United States Patent
Mazzeo et al.

(10) Patent No.: US 10,378,358 B2
(45) Date of Patent: Aug. 13, 2019

(54) ROTARY ACTUATOR UTILIZING PNEUMATICALLY ACTUATED ELASTOMERIC STRUCTURES

(71) Applicant: Rutgers, The State University of New Jersey, New Brunswick, NJ (US)

(72) Inventors: Aaron Mazzeo, Dunellen, NJ (US); Ke Yang, Parlin, NJ (US); Xiangyu Gong, Edison, NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 203 days.

(21) Appl. No.: 15/355,861

(22) Filed: Nov. 18, 2016

(65) Prior Publication Data

US 2017/0145825 A1 May 25, 2017

Related U.S. Application Data

(60) Provisional application No. 62/257,461, filed on Nov. 19, 2015.

(51) Int. Cl.

| | |
|---|---|
| ***F01B 19/04*** | (2006.01) |
| ***F15B 15/10*** | (2006.01) |
| ***F01C 1/00*** | (2006.01) |
| ***F02B 55/14*** | (2006.01) |

(52) U.S. Cl.
CPC ..... *F01B 19/04* (2013.01); *F01C 1/00* (2013.01); *F02B 55/14* (2013.01); *F15B 15/10* (2013.01)

(58) Field of Classification Search
CPC ..... F01C 1/00; F01C 5/02; F04C 5/00; F04C 15/0003; F04C 15/003
See application file for complete search history.

(56) References Cited

U.S. PATENT DOCUMENTS 3,680,982 A * 8/1972 Jacobellis ..... F15B 15/103 417/392
3,977,648 A * 8/1976 Sigmon ..... F15B 15/103 251/59
5,879,147 A * 3/1999 Suzumori ..... F01C 5/02 418/153

* cited by examiner

*Primary Examiner* — Thomas E Lazo
(74) *Attorney, Agent, or Firm* — Fox Rothschild LLP

(57) ABSTRACT

A rotary actuator and a method of using same are disclosed. The rotary actuator includes a rotor having a body and defining a plurality of contact surfaces, and a stator having a body and defining a plurality of inflatable bladders circumferentially spaced about the stator body. The stator is positioned relative to the rotor such that upon sequential inflation of the plurality of inflatable bladders, the rotor is caused to rotate.

25 Claims, 16 Drawing Sheets

ROTARY ACTUATOR UTILIZING PNEUMATICALLY ACTUATED ELASTOMERIC STRUCTURES

CROSS-REFERENCE TO RELATED APPLICATIONS

This application claims the benefit of U.S. Provisional Application No. 62/257,461, filed Nov. 19, 2015, the contents of which are incorporated herein by reference.

TECHNICAL FIELD

The present disclosure relates to rotary actuators based on inflatable elastomeric structures, which consist of a stator and a rotor. Timed inflation and deflation of the air-filled channels in the stator enable the rotation of the rotor. The rotary actuators have application in extending the functionality of soft robotic systems and machines for use in, for example, missions of search and rescue, exploration of space, medicine, biology, artificial joints for robots and friendly human rehabilitation.

BACKGROUND

Conventional rovers and wheeled vehicles typically consist of many hard material-based parts that constitute the chassis and rotating components (e.g., rims of wheels, axles, transmission, and motors). With the exception of the tires and suspension, general design principles base material selection on high strength and elastic modulus.

While there are many advantages to using hard materials in these applications, there have been a range of efforts to incorporate soft materials into land-based locomotors. Two of the most notable ones consist of recent efforts in the motion of tensegrity-based structures and bending/extending soft robots based on large induced strains. While tensegrity-based robots are capable of rolling, both classes of soft robots have a similar dilemma to that found in nature: the lack of wheels. It would thus be desirable to have rotary actuators based on inflatable elastomeric structures, which avoid the disadvantages of state-of-the-art soft robots, particularly with respect to the limited rotational capabilities of such soft robots.

SUMMARY

In a first aspect, there is provided herein a rotary actuator including a rotor having a body and defining a plurality of contact surfaces and a stator having a body and defining a plurality of inflatable bladders circumferentially spaced about the stator body. The stator is positioned relative to the rotor such that upon sequential inflation of the plurality of inflatable bladders, the rotor is caused to rotate.

In certain embodiments, the rotor is positioned internally of the stator.

In certain embodiments, the body of the internally positioned rotor includes a central axis CA and defines a plurality of wells disposed therebetween the plurality of contact surfaces.

In certain embodiments, the body of the internally positioned rotor includes a connector plate disposed at one end thereof.

In certain embodiments, the body of the internally positioned rotor includes a plurality of ribs that define the plurality of contact surfaces on each side of the ribs such that the internally positioned rotor can be rotated in either direction.

In certain embodiments, the body of the internally positioned rotor includes four ribs such that four contact surfaces are defined in each direction of rotation.

In certain embodiments, the rotor is fabricated from 3D printed ABS or cast/assembled layers of Mold Star 30 and a layer of PDMS or any suitable elastomeric material and the stator is fabricated from Ecoflex 50 or any suitable elastomeric material.

In certain embodiments, the plurality of inflatable bladders are actuated in sets to sequentially rotate the rotor.

In certain embodiments, the plurality of inflatable bladders in each set are equal to the plurality of contact surfaces on the rotor such that each contact surface is contacted by a respective inflatable bladder of the set during a specific actuation.

In certain embodiments, the body of the stator is configured to extend about an internal opening that is variably sized to receive the rotor therein.

In certain embodiments, each inflatable bladder is configured to be spaced at a step angle $\alpha$ that is dependent on the number of inflatable bladders such that when sixteen inflatable bladders are defined the step angle $\alpha$ is 22.5°.

In certain embodiments, the rotor is positioned externally of the stator.

In certain embodiments, the body of the externally positioned rotor is disposed between a pair of opposed plates and defines a central opening having a configuration that defines a plurality of wells disposed therebetween the plurality of contact surfaces.

In certain embodiments, the plurality of contact surfaces are defined by flat sides of the central opening and the plurality of wells are defined in rounded corners of the central opening.

In certain embodiments, the externally positioned rotor includes four contact surfaces that are contacted on opposite ends thereof to achieve rotation in each direction.

In certain embodiments, the body of the stator is sized to be received within a central opening of the rotor.

In certain embodiments, the stator is formed in a mold having a central portion configured to define an opening and a plurality of fins configured to define the respective plurality of inflatable bladders.

In certain embodiments, the plurality of fins are positioned to form the plurality of inflatable bladders proximate a wall of the opening when the stator is positioned externally of the rotor.

In certain embodiments, the plurality of fins are positioned to form the plurality of inflatable bladders proximate an outer wall of the stator body when the stator is positioned internally of the rotor.

In certain embodiments, a pair of rotary actuators is configured for use in a winch device such that the rotor of each actuator is connected to a spindle from which a string extends and fluid tubes are connected to each stator and controlled to cause rotation of the rotor and the spindle.

In certain embodiments, forward rotation causes the spindle to lower a grip that is pneumatically controlled through a line and rearward rotation causes the spindle to raise the grip.

In certain embodiments, a pair of rotary actuators is configured for use in a two-wheel vehicle such that the two-wheel vehicle includes an elastomeric body having an elastomeric axle on each end with each elastomeric axle configured to support a respective rotary actuator.

In certain embodiments, a plurality of fluid tubes are connected to each stator and controlled to cause rotation of each rotor which in turn causes the two-wheel vehicle to move forward or backward.

In certain embodiments, a pair of two-wheel vehicles is configured for use in a four-wheel vehicle connected by an elastomeric chassis.

In certain embodiments, a plurality of fluid tubes are connected to each stator and controlled to cause rotation of each rotor which in turn causes the four-wheel vehicle to move forward or backward.

In a second aspect, there is provided herein a method of using a rotary actuator. The method includes: providing a rotary actuator as disclosed herein such that the plurality of inflatable bladders are actuated in sets to sequentially rotate the rotor, the plurality of inflatable bladders in each set is equal to the plurality of contact surfaces on the rotor such that each contact surface is contacted by a respective inflatable bladder of the set during a specific actuation; and actuating the plurality of inflatable bladders such that they first contact a respective contact surface and expand into a well that is disposed therebetween the contact surface and the body of the rotor and the subsequent inflatable bladder set begins inflation as the previous inflatable bladder set finishes deflation.

In certain embodiments, the rotor is fabricated from 3D printed ABS or cast/assembled layers of Mold Star 30 and a layer of PDMS or any suitable elastomeric material and the stator is fabricated from Ecoflex 50 or any suitable elastomeric material.

Various advantages of this disclosure will become apparent to those skilled in the art from the following detailed description, when read in light of the accompanying drawings.

DETAILED DESCRIPTION

Figure 1:
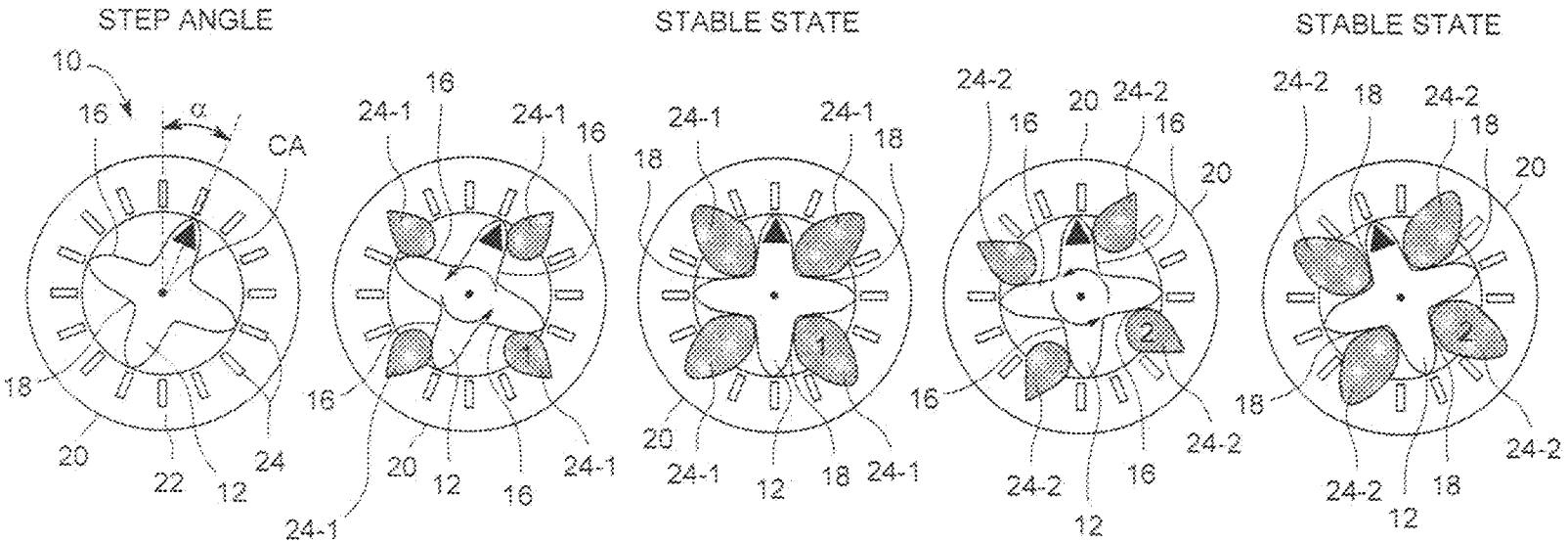
FIG. 1 includes schematic side elevation views showing sequential actuation of an exemplary "Type 1" rotary actuator in accordance with an embodiment of the present disclosure.

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the disclosure is not limited to structures having the specific sizes or dimensions recited below. As used herein, the term "comprising" means "including, but not limited to."

In consideration of the figures, it is to be understood for purposes of clarity that certain details of construction and/or operation are not provided in view of such details being conventional and well within the skill of the art upon disclosure of the document described herein.

In the figures, like numerals indicate like elements throughout. The following describes exemplary embodiments of the present disclosure. However, it should be understood that the present disclosure is not limited by the exemplary embodiments described herein.

To address the limited rotational capabilities of state-of-the-art soft robots, the present disclosure provides vehicles and other devices with a novel configuration of inflatable stators paired with rotors. In particular, a vehicle incorporating the rotary actuators of the present disclosure includes soft-bodied subsystems with elastomeric axles, stators, and rotors of high toughness for improved mechanical resilience with fewer parts. With only a few molded components, the locomotion or rotary actuation in the wheels comes through biologically-inspired peristalsis that uses alternating inflation and deflation of pneumatic chambers. These pneumatically-driven vehicles and wheels have the potential to negotiate varied and wet terrains, be lightweight, be safe, be impervious to electromagnetic interference, and withstand mechanical impact. This concept may be configured, for example, for rovers for missions requiring the transport of samples or research equipment.

The context for a possible mission is in deployment and navigation on a planet (e.g., Mars), a comet (e.g., Comet 67P/Churyumov-Gerasimenko), or a piece of terrain-navigable debris in space. As exemplary missions, The Mars Spirit and Opportunity rovers have demonstrated one approach. Briefly, the landers containing the rovers used cocoons that impacted and bounced on the surface of the planet. The space within the cocoons was very tight and careful planning for packing of the rovers was necessary for the terrain-navigating apparatuses. Between impact (i.e., landing) and egress (i.e., deployment of the rover), many planned activities occurred, with some involving the unfolding and origami-like reconfiguration of the rovers. Then, once the rover deployed itself from the lander, the rover began its navigation of difficult and varied terrain, which required more planning and coordination to ensure the complicated suspension might be able to navigate over rocks or along hills without getting stuck or tipping.

In this mission context, a squishy vehicle with soft wheels should provide a few benefits. First, a soft vehicle will be able to withstand higher impact than one composed of rigid members, which could reduce the requirements or eliminate the need for conventional landers altogether. As researchers have demonstrated recently, elastomeric robots are capable of withstanding impact with a hammer, flattening under the wheel of an automobile, or significant compression. Second, a robot with soft wheels and a squishy body will not need complicated unfolding routines like those employed with the front wheels of Opportunity and Spirit rovers. Instead, the soft vehicle will be compressed into a ball-like form—minimized ratio of surface area to volume—before deployment and expand freely for egress. Third, the rotors and stators for the wheels will not contain any magnetic or metallic components, which will allow them to maintain their functionality in the presence of high electric or magnetic fields. Fourth, navigation over difficult terrain with a naturally compliant set of wheels and suspension will eliminate some of the complexity associated with rigid members and complex suspensions, which require actuated lifting of wheels over obstacles. Fifth, these soft rovers will be capable of exceeding the mobility (i.e., ability to cover distances on land) of state-of-the-art pneumatic soft robots, which depend on crawling, undulating, or uncontrolled jumping. Sixth, soft rovers will provide safe human-machine interactions, as the likelihood of puncturing or tearing the fabric of space suits will be much less. Finally, if a soft vehicle were to roll over, the likelihood of damage to the rotating mechanisms and the chassis should be significantly less, although there still might be the issue of righting the vehicle.

Figure 2:
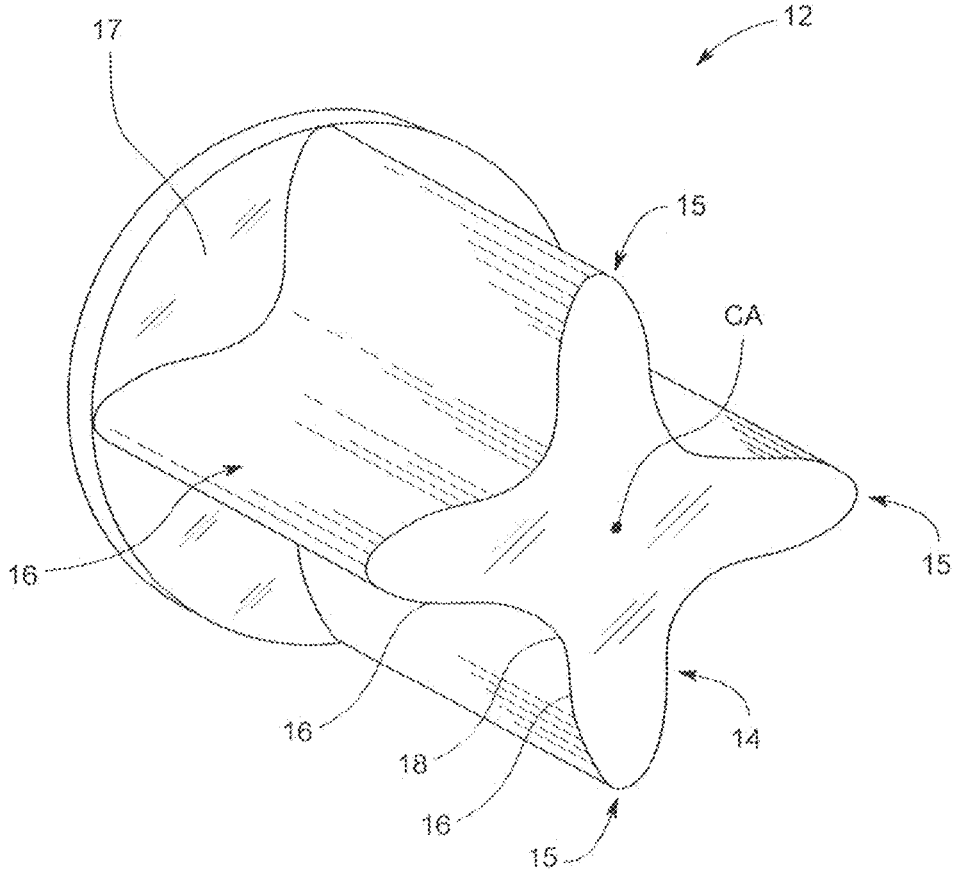
FIG. 2 is a perspective view of an exemplary rotor of the rotary actuator of FIG. 1.
Figure 3:
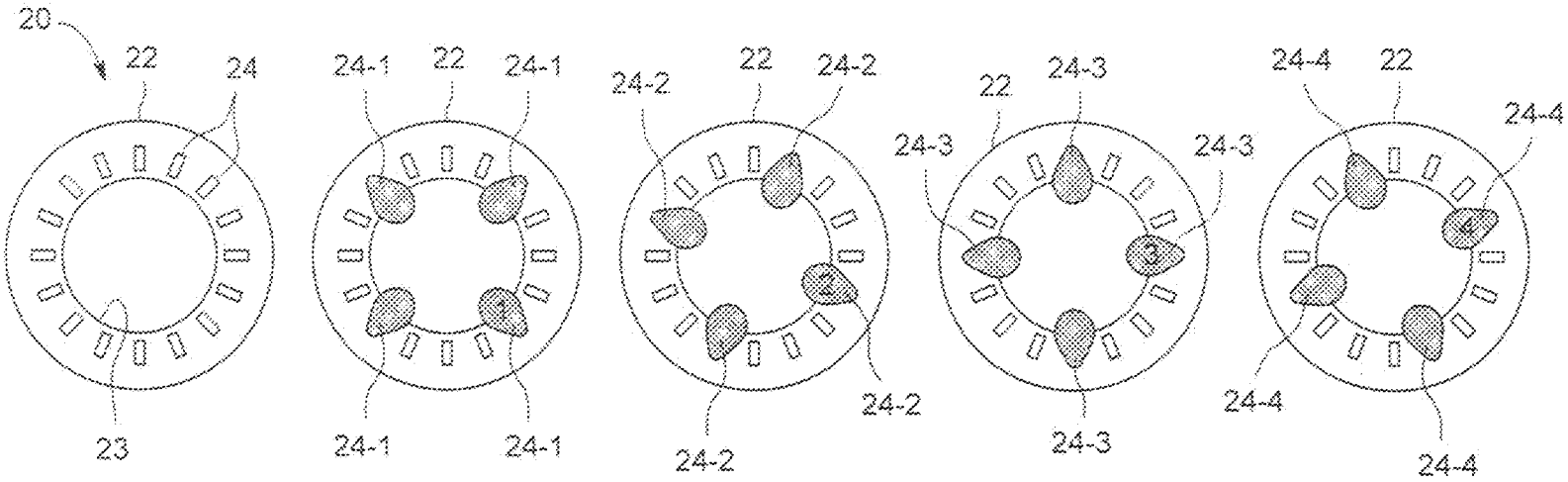
FIG. 3 includes schematic side elevation views showing sequential actuation of an exemplary stator of the rotary actuator of FIG. 1.

Referring now to FIGS. 1-3, a Type 1 rotary actuator 10 with a fixed external stator 20 and an interior moving rotor 12 will be described. The external stator 20 and the interior moving rotor 12 are each manufactured from an elastomeric material such that they may be squished and then returned to the illustrated natural configuration. As an example, in the present embodiment, the rotor 12 may be 3D printed ABS and the stator 20 may be Ecoflex 50. These cast/molded soft materials may be molded off 3D-printed, machined, or otherwise constructed structures. It should be understood that the rotor 12 and stator 20 can be fabricated from any suitable non-elastomeric material such as hard plastic and the like. Rotation occurs with coordinated inflation of bladders 24, as described below.

In the present embodiment, the interior rotor 12 includes a body 14 having a central axis CA and which defines a plurality of contact surfaces 16 with wells 18 therebetween. The body 14 includes a plurality of ribs 15 which define contact surfaces 16 on each side of the ribs 15 such that the rotor 12 may be rotated in either direction. The wells 18 are defined wherein the ribs 15 meet at the body 14. The illustrated rotor 12 includes a connector plate 17 at one end of the body 14. In the present embodiment, the rotor 12 includes four ribs 15 such that four contact surfaces 16 are defined in each direction of rotation. The rotor 12 may be configured to define more or fewer contact surfaces.

The fixed external stator 20 includes an annular body 22 extending about an internal opening 23 which is sized to receive the rotor 12 therein. A plurality of bladders 24 are defined circumferentially spaced about the body 22. Each bladder 24 is spaced at a step angle $\alpha$ which is dependent on the number of bladders 24. In the illustrated embodiment, sixteen bladders 24 are defined such that the step angle $\alpha$ is 22.5°.

Figure 8:
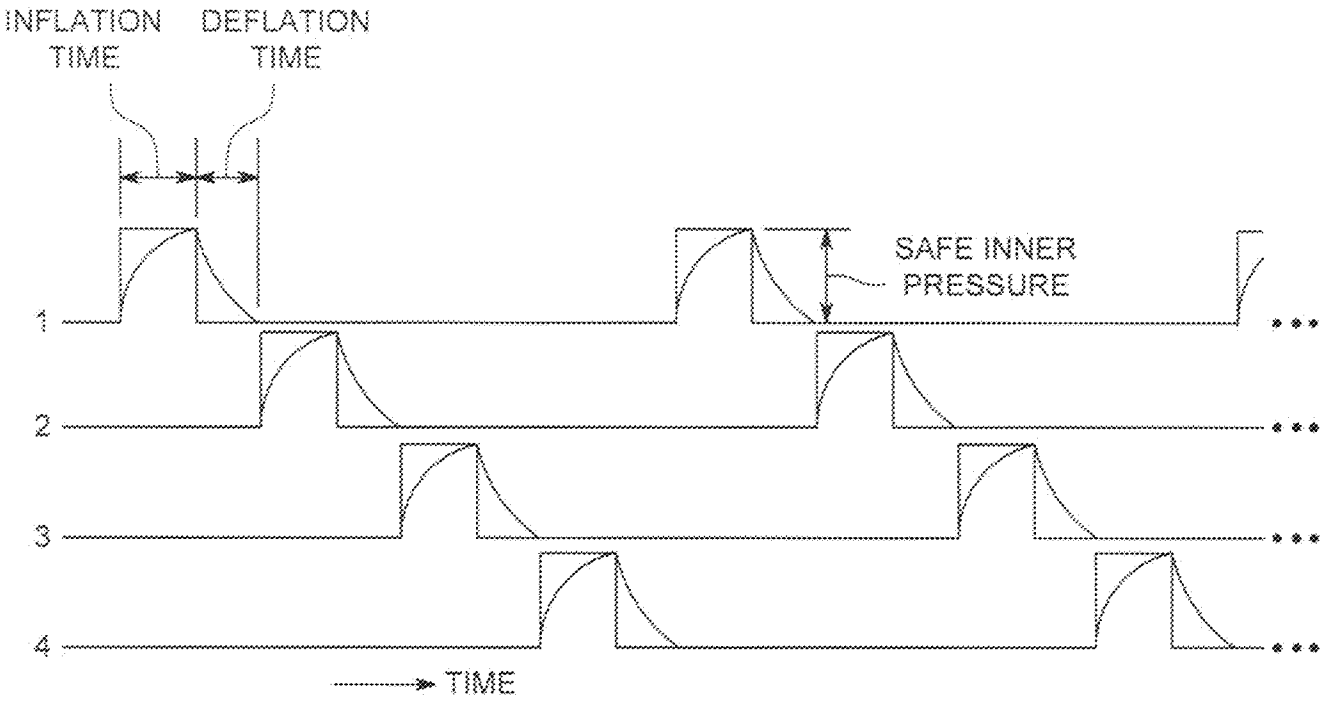
FIG. 8 illustrates an exemplary control pattern for the inflatable bladders of the stators described herein.

In operation, the bladders 24 are actuated in sets to sequentially rotate the rotor 12. The number of bladders 24 in each set is preferably equal to the number of contact surfaces 16 on the rotor 12 such that each contact surface 16 is contacted by a respective bladder 24 of the set during a specific actuation. The bladders 24 will be actuated such that they first contact a respective contact surface 16 and then expand into the well 18 as illustrated in FIG. 1. By actuating the various bladder sets sequentially, continuous rotation of the rotor 12 may be achieved. This is shown in FIG. 3 wherein the bladders 24-1 of the first subset are actuated, thereafter the bladders 24-2 of the second subset are actuated, then the bladders 24-3 of the third subset and finally the bladders 24-4 of the fourth subset to achieve a full revolution. FIG. 8 illustrates an exemplary control pattern for each of the subsets 1 through 4, with subset 2 beginning inflation as subset 1 finishes deflation and so on.

Figure 4:
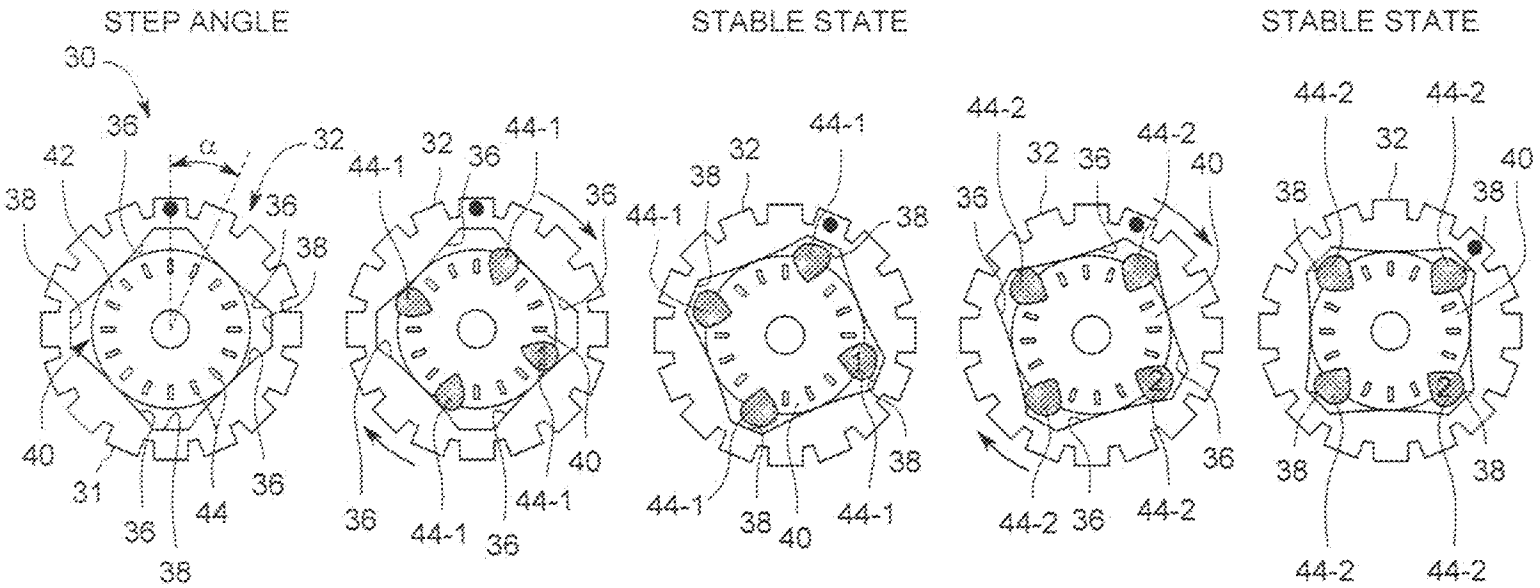
FIG. 4 includes schematic side elevation views showing sequential actuation of an exemplary "Type 2" rotary actuator in accordance with an embodiment of the present disclosure.
Figure 5:
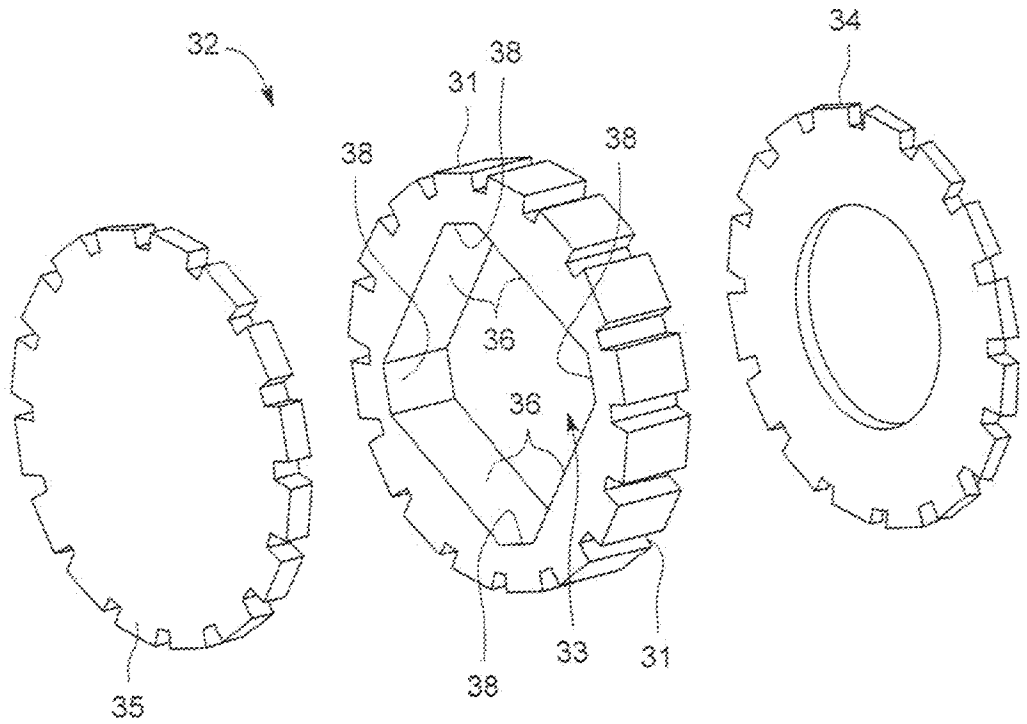
FIG. 5 is an exploded perspective view of an exemplary rotor of the rotary actuator of FIG. 4.
Figure 6:
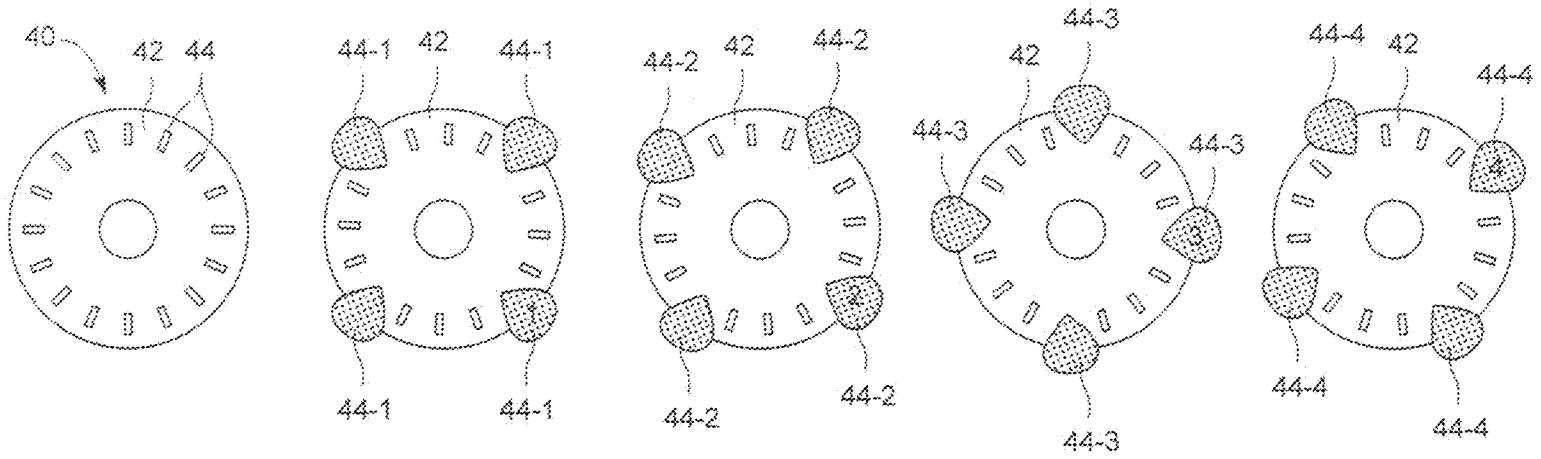
FIG. 6 includes schematic side elevation views showing sequential actuation of an exemplary stator of the rotary actuator of FIG. 4.

Referring to FIGS. 4-6, a Type 2 rotary actuator 30 with a fixed interior stator 40 and an external moving rotor 32 will be described. The interior stator 40 and the external moving rotor 32 are each manufactured from an elastomeric material such that they may be squished and then returned to the illustrated natural configuration. As an example, in the present embodiment, the rotor 32 may be cast/assembled layers of Mold Star 30 and a layer of PDMS and the stator 40 may be Ecoflex 50. These cast/molded soft materials may be molded off 3D-printed, machined, or otherwise constructed structures. It should be understood that the rotor 32 and stator 40 can be fabricated from any suitable non-elastomeric material such as hard plastic and the like. Rotation occurs with coordinated inflation of bladders 44, as described below.

In the present embodiment, the external rotor 32 includes a main body 31 between opposed plates 34 and 35. The main body 31 defines a central opening 33 having a configuration which defines a plurality of contact surfaces 36 with wells 38 therebetween. The contact surfaces 36 are defined by the flat sides of the opening 33 and the wells 38 are defined in the rounded corners of the opening 33. In the present embodiment, the rotor 32 includes four contact surfaces 36 which are contacted on opposite ends thereof to achieve rotation in each direction. The rotor 32 may be configured to define more or fewer contact surfaces.

The fixed interior stator 40 includes an annular body 42 which is sized to be received within the opening 33 of the rotor 32. A plurality of bladders 44 are defined circumferentially spaced about the body 42. Each bladder 44 is spaced at a step angle $\alpha$ which is dependent on the number of bladders 44. In the illustrated embodiment, sixteen bladders 44 are defined such that the step angle $\alpha$ is 22.5°.

Similar to the previous embodiment, the bladders 44 are actuated in sets to sequentially rotate the rotor 32. The number of bladders 44 in each set is preferably equal to the number of contact surfaces 36 on the rotor 32 such that each contact surface 36 is contacted by a respective bladder 44 of the set during a specific actuation. The bladders 44 will be actuated such that they first contact a respective contact surface 36 and then expand into the well 38 as illustrated in FIG. 4. By actuating the various bladder sets sequentially, continuous rotation of the rotor 32 may be achieved. This is shown in FIG. 6 wherein the bladders 44-1 of the first subset are actuated, thereafter the bladders 44-2 of the second subset are actuated, then the bladders 44-3 of the third subset and finally the bladders 44-4 of the fourth subset to achieve a full revolution. As in the previous embodiment, FIG. 8 illustrates an exemplary control pattern for each of the subsets 1 through 4, with subset 2 beginning inflation as subset 1 finishes deflation and so on.

Figure 7:
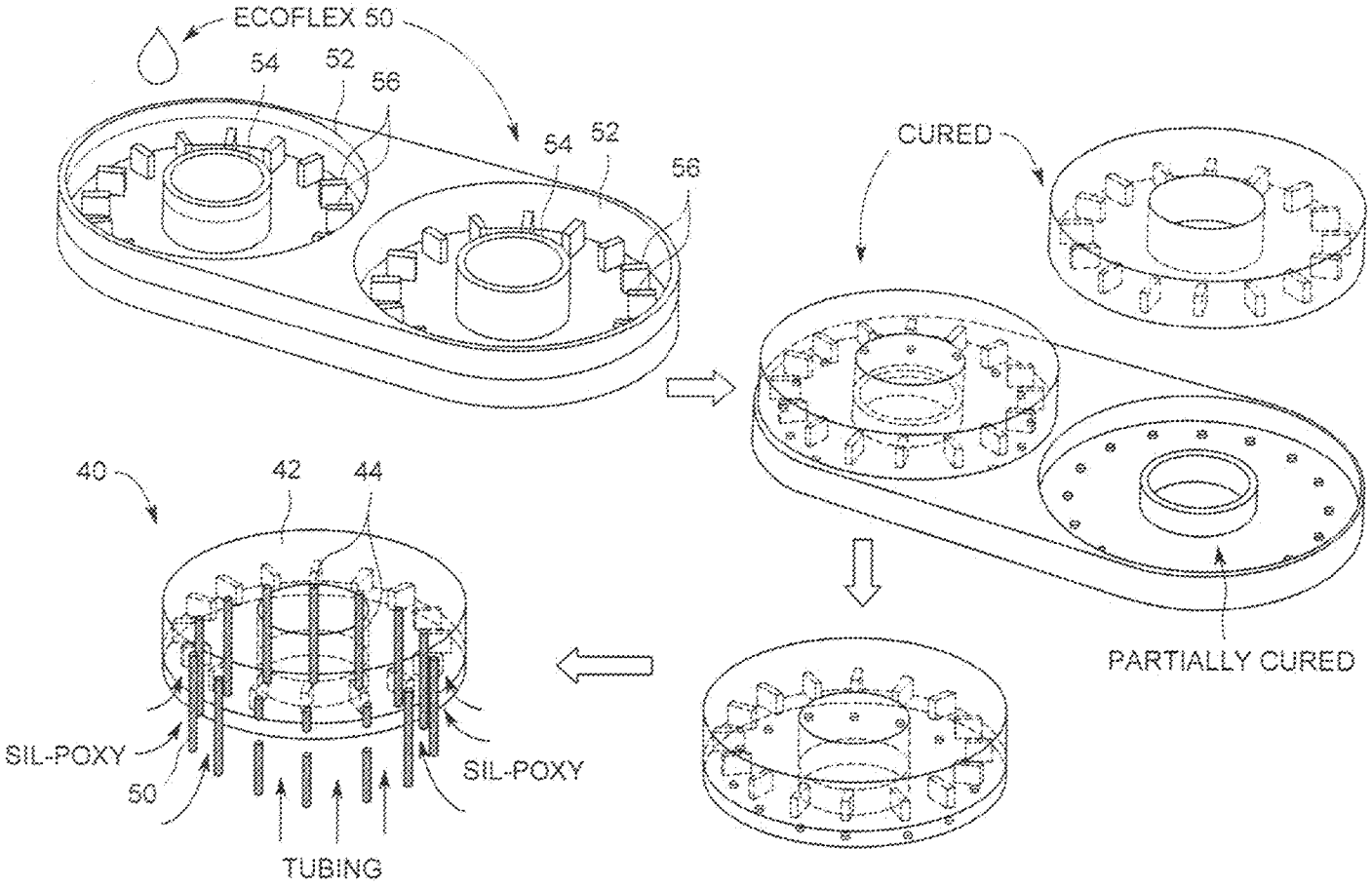
FIG. 7 includes schematic perspective views illustrating an exemplary process of manufacturing the stator of FIG. 6.

FIG. 7 illustrates an exemplary embodiment for manufacturing the stators 20, 40. The stators 20, 40 may be formed in a mold 52 with a central portion 54 which defines the opening and a plurality of fins 56 which define the respective bladders 24, 44. For the external stator 20, the fins 56 are positioned to form the bladders 24 proximate the wall of the opening 23. For the internal stator 40, the fins 56 are positioned to form the bladders 44 proximate the outer wall of the body 42. A fluid tube 50 is positioned in each bladder 24, 44 and sealed therein. As such, when fluid, for example air, is passed through the tube 50, the respective bladder 24, 44 is caused to expand.

Figure 9:
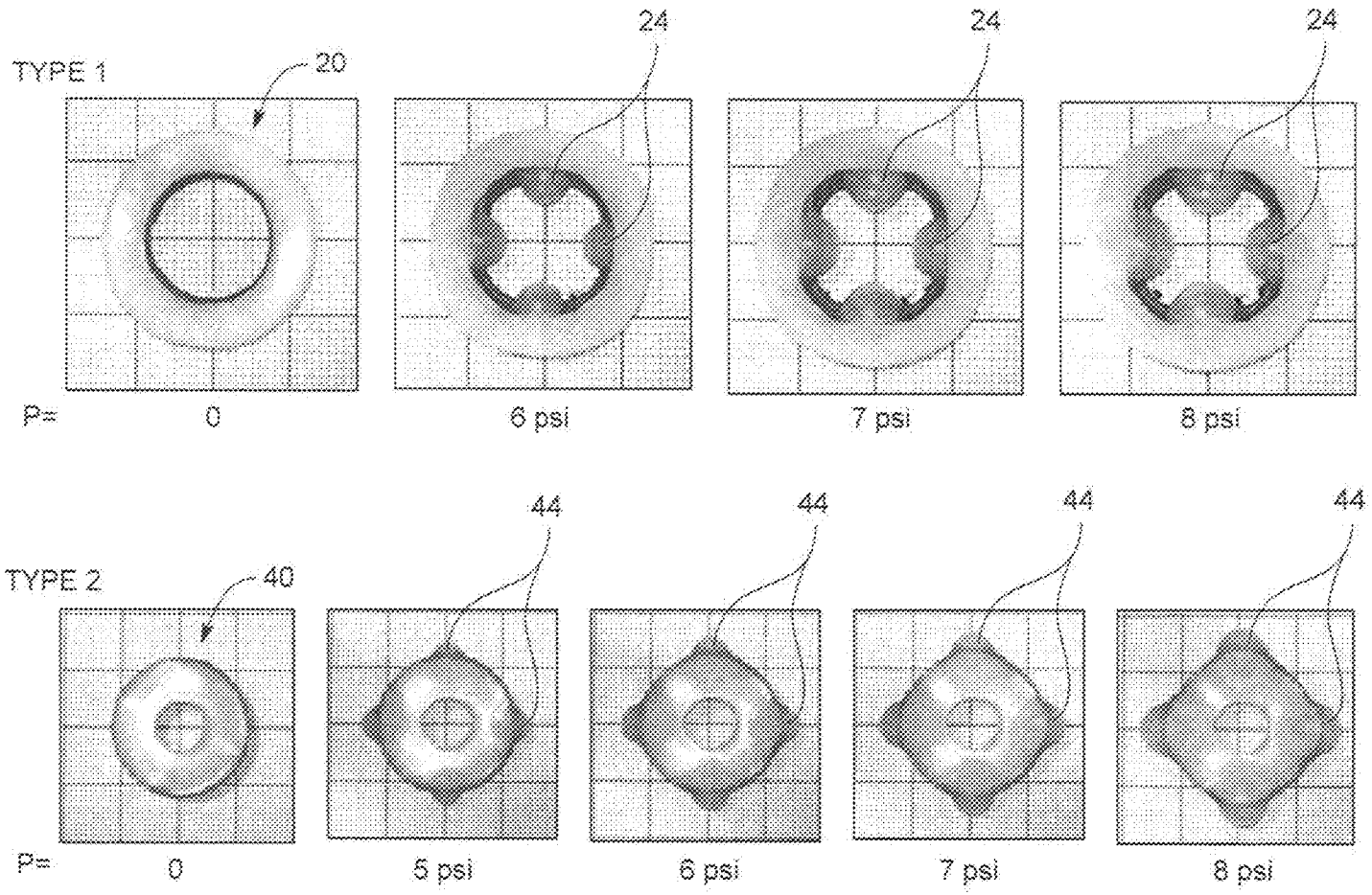
FIG. 9 includes schematic views illustrating expansion of the inflatable bladders of the Type 1 and Type 2 stators at different pressures.
Figure 10:
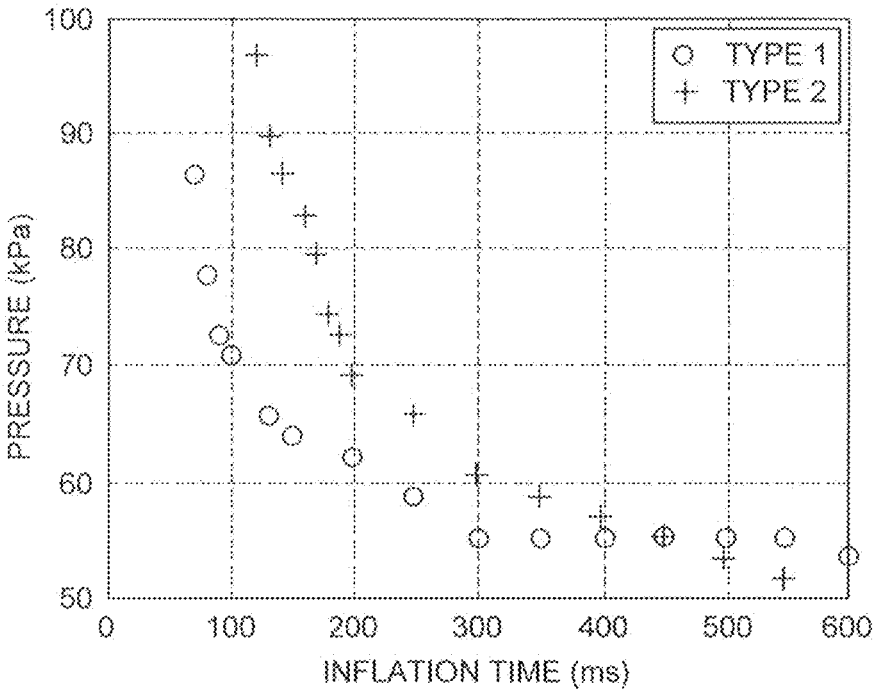
FIG. 10 is a graph plotting pressure versus inflation time for the inflatable bladders of exemplary Type 1 and Type 2 stators.
Figure 11:
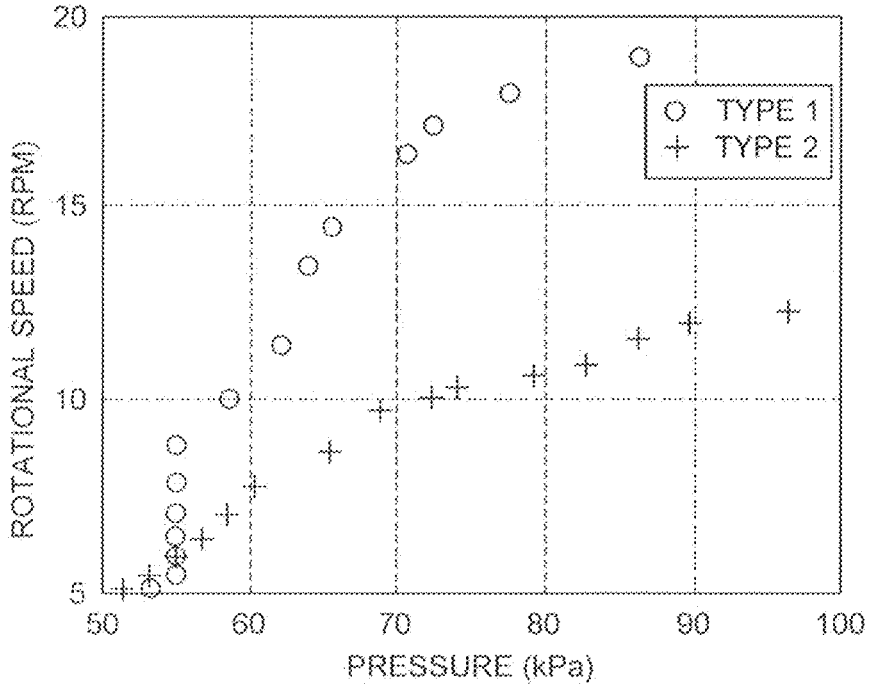
FIG. 11 is a graph plotting rotation speed versus pressure for exemplary Type 1 and Type 2 stators.

FIG. 9 illustrates the expansion of a set of bladders 24, 44 for both the Type 1 and Type 2 stators 20, 40 at various pressures. The pressure is preferably selected to inflate the bladders such that they are large enough to actuate the rotor but will not damage the material. As illustrated in FIG. 10, the lower the pressure, the longer it takes to inflate each bladder. As a result, the lower pressure results in a lower rotation speed as illustrated in FIG. 11. The rotational speed was calculated as: Rotational Speed (RPM)=((60 sec/min)*(1000 msec/sec)) divided by ((16 group/rotation)*($t_{inflation}$+$t_{deflation}$)).

Figure 12:
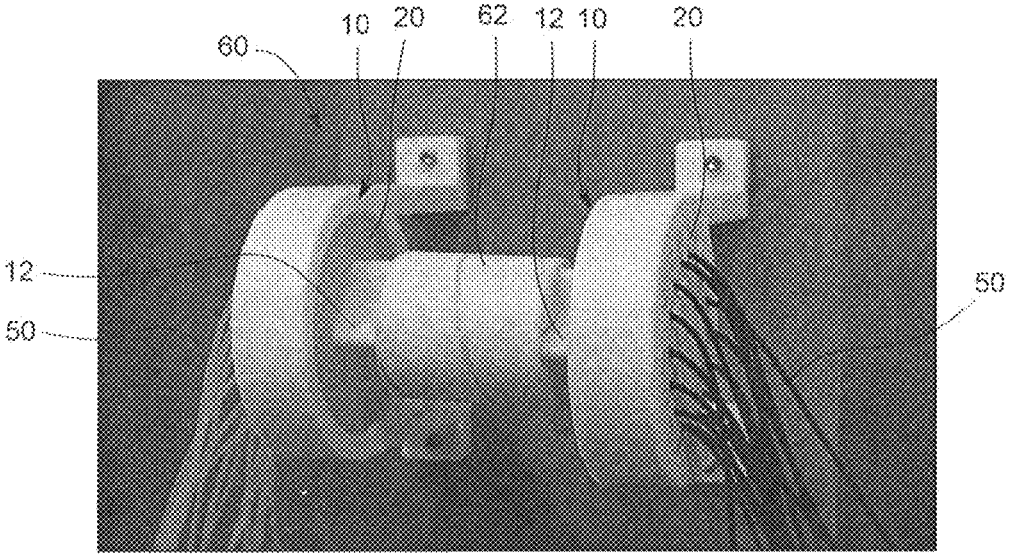
FIGS. 12, 13 and 14 illustrate an exemplary winch incorporating a pair of Type 1 rotary actuators.
Figure 13:
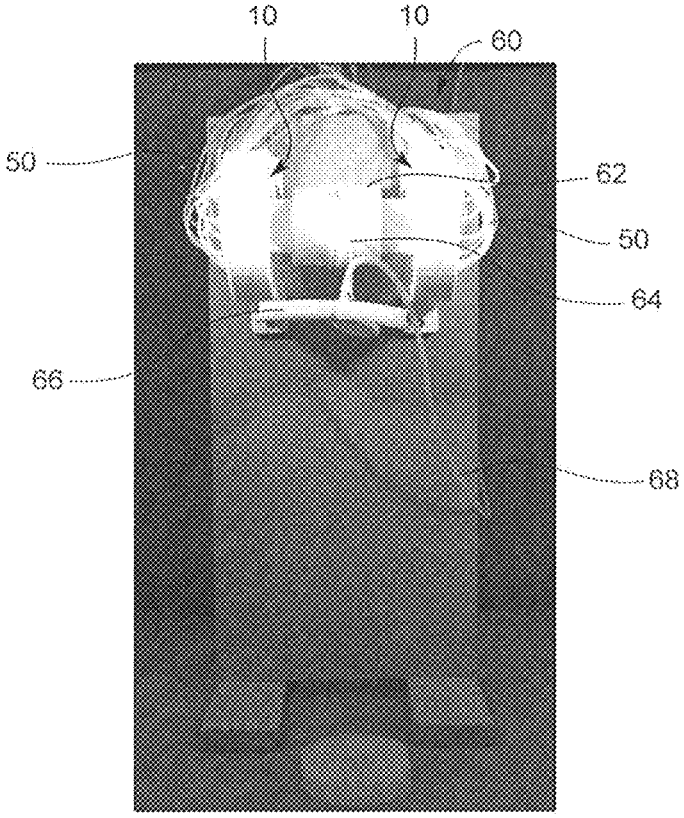
Figure 14:
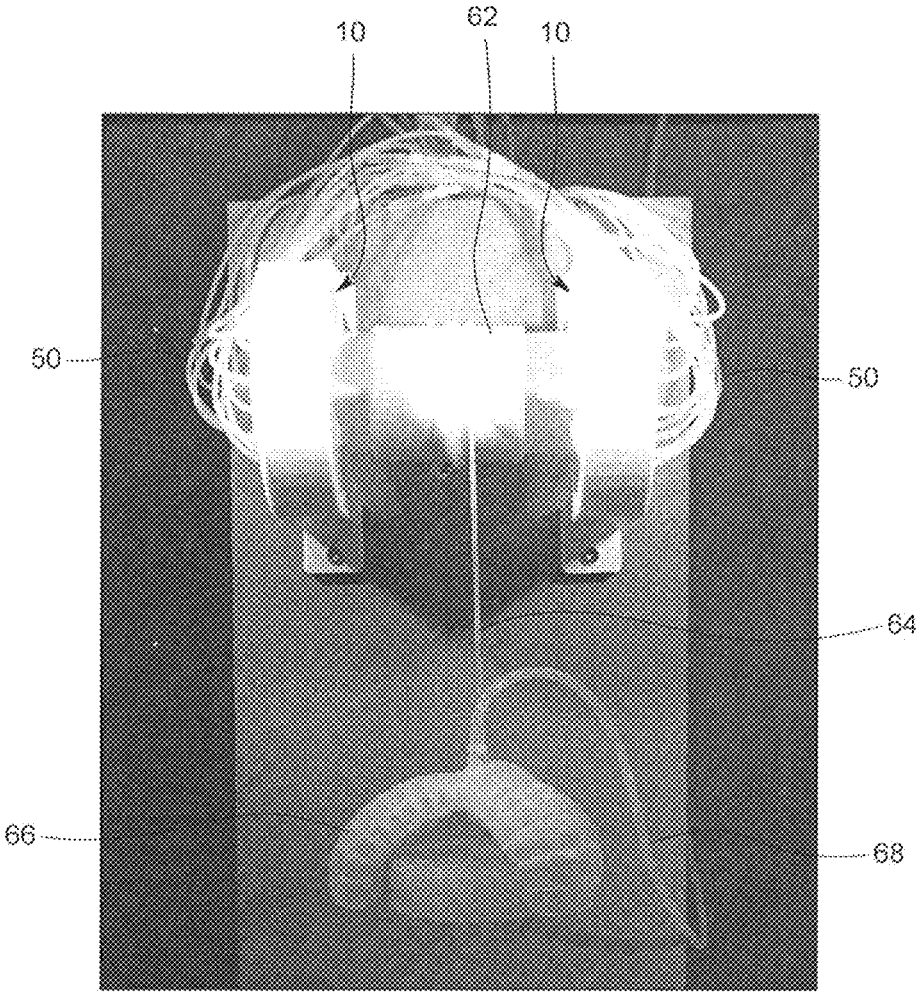

Referring to FIGS. 12-14, an exemplary winch device 60 incorporating two Type 1 rotary actuators 10 will be described. The rotor 12 of each actuator 10 is connected to a spindle 62 from which a string 64 extends. The fluid tubes 50 are connected to the stators 20 and controlled as described above to cause rotation of the rotors 12 and thereby the spindle 62. Forward rotation causes the spindle 62 to lower a grip 66 which is pneumatically controlled through line 68 and rearward rotation causes the spindle 62 to raise the grip 66.

Figure 15:
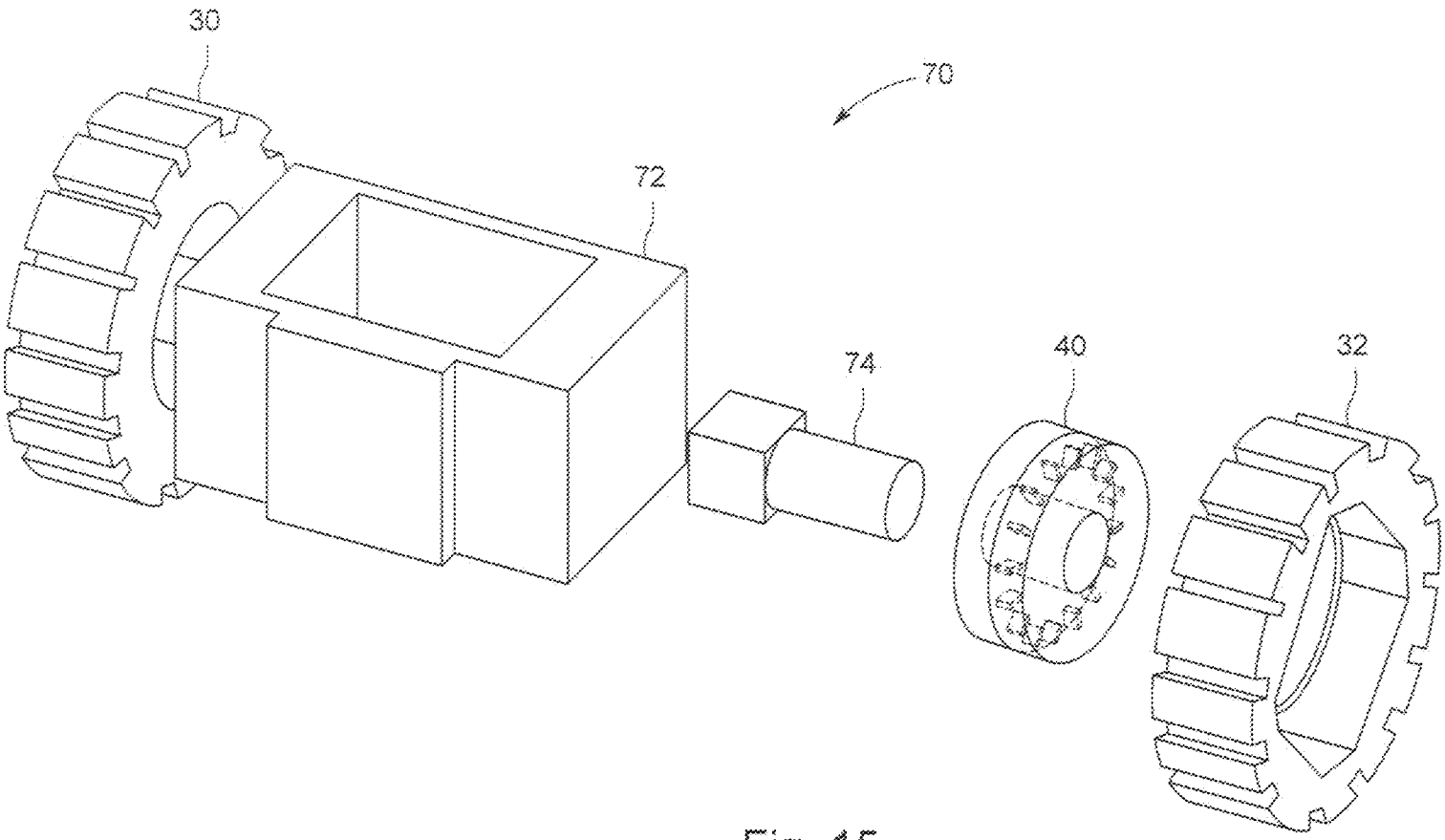
FIGS. 15, 16 and 17 illustrate an exemplary two-wheel vehicle incorporating a pair of Type 2 rotary actuators, with FIGS. 15 and 16 partially exploded.
Figure 16:
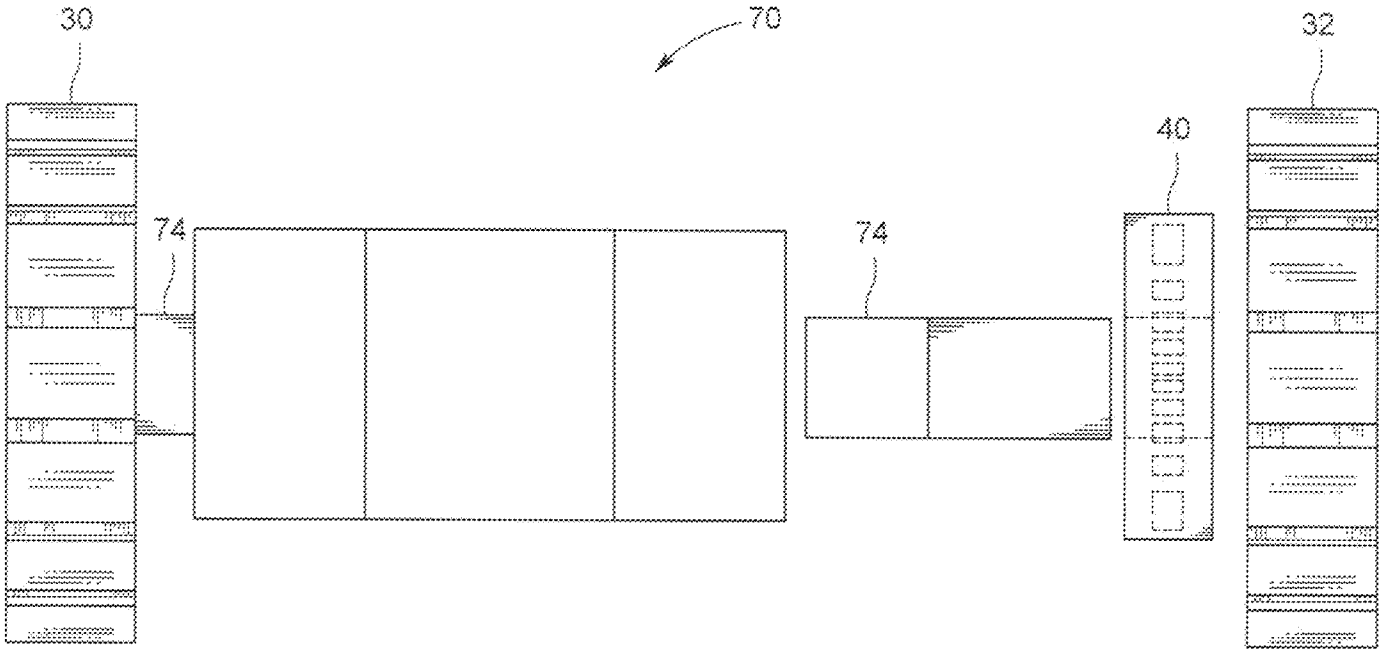
Figure 17:
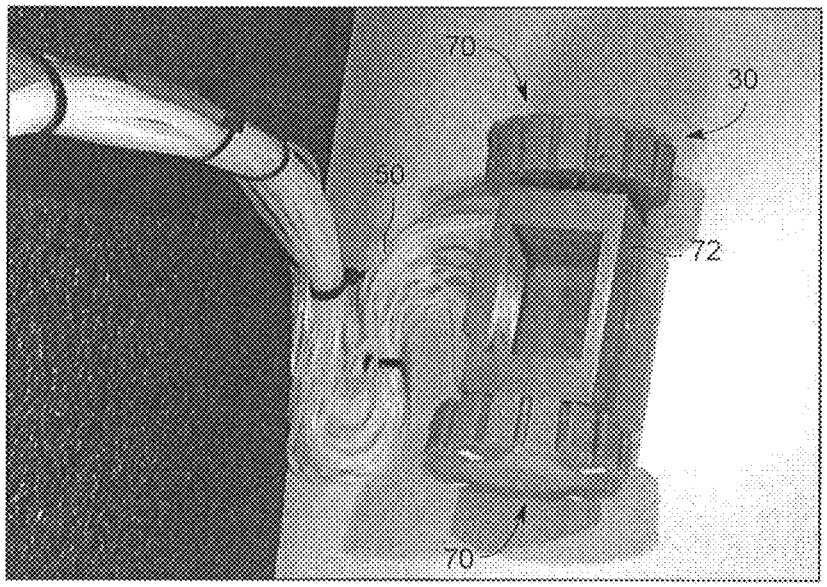

Referring to FIGS. 15-17, an exemplary two-wheel vehicle 70 incorporating two Type 2 rotary actuators 30 will be described. The vehicle 70 includes a body 72 with axles 74 on each end with each axle 74 configured to support a respective actuator 30. The body 72 and axles 74 are preferably manufactured from an elastomeric material similar to the actuators so they may also be collapsed and return to the illustrated configuration. Fluid tubes 50 are connected to the stators 40 and controlled as described above to cause rotation of the rotors 32 which in turn causes the vehicle 70 to move forward or backward.

Figure 18:
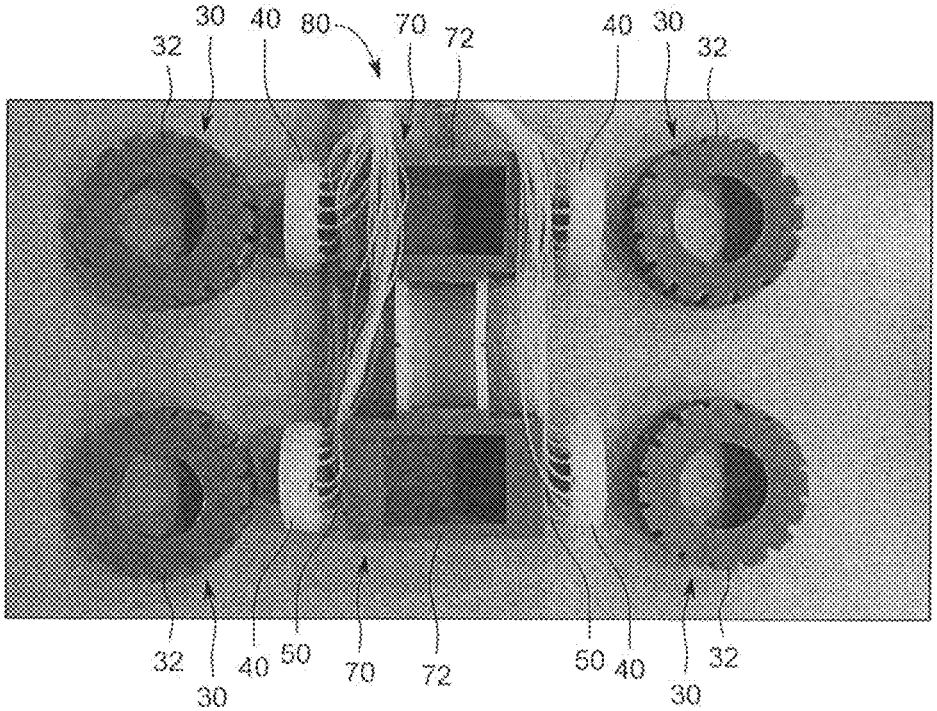
FIGS. 18, 19 and 20 illustrate an exemplary four-wheel vehicle incorporating four of the Type 2 rotary actuators, with FIG. 18 partially exploded.
Figure 19:
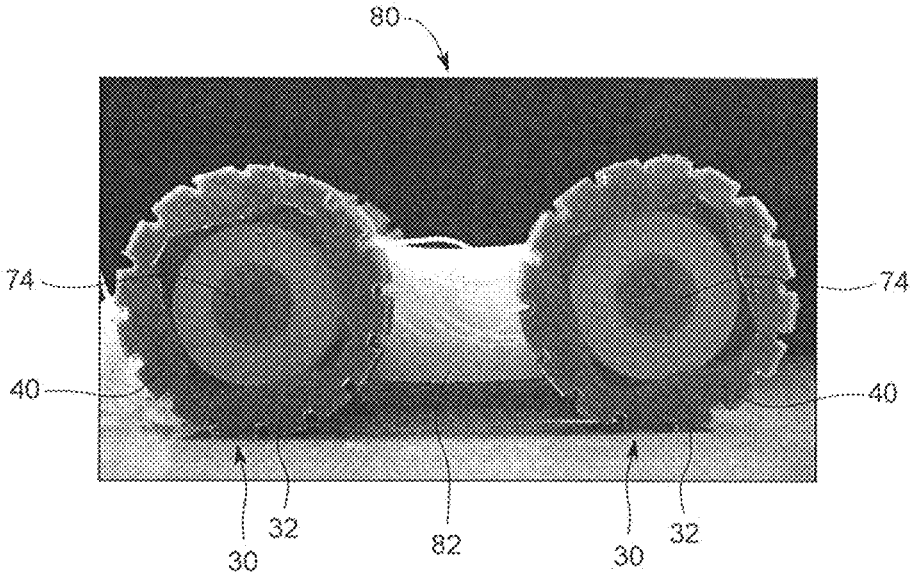
Figure 20:
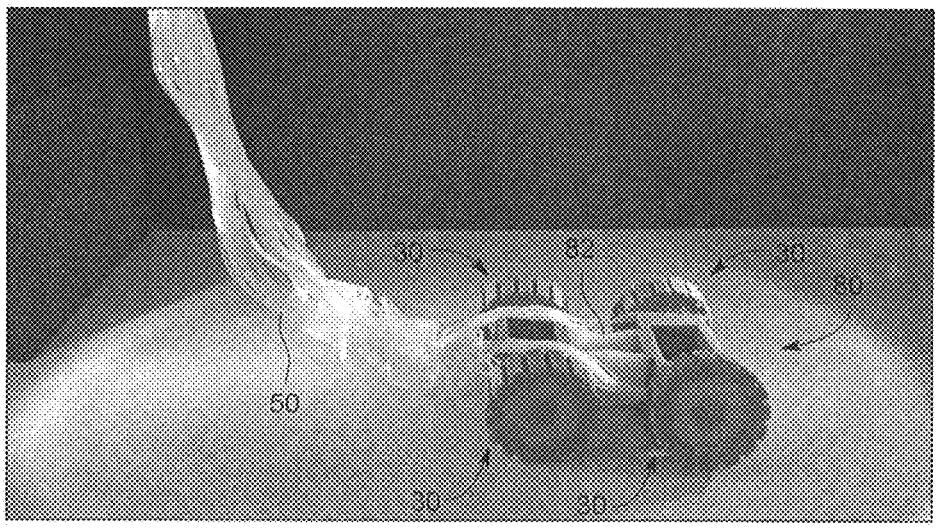

FIGS. 18-20 illustrate an exemplary four-wheel vehicle 80 which includes a pair of the two-wheel vehicles 70 connected by an elastomeric chassis 82. Again, fluid tubes 50 are connected to the stators 40 and controlled as described above to cause rotation of the rotors 32 which in turn causes the vehicle 80 to move forward or backward.

As one exemplary application, the rotary actuators described herein have the potential of greatly simplifying the mechanical complexity associated with current landing and roving systems. More specifically, the benefits may include being able to store and squeeze the vehicle in tight spaces; overcoming the problems of slow, laborious locomotion in state-of-the art undulating/crawling soft robots; and being able to withstand mechanical impact.

These and other advantages of the present disclosure will be apparent to those skilled in the art from the foregoing specification. Accordingly, it will be recognized by those skilled in the art that changes or modifications may be made to the above-described embodiments without departing from the broad inventive concepts of the disclosure. It should therefore be understood that this disclosure is not limited to the particular embodiments described herein, but is intended to include all changes and modifications that are within the scope and spirit of the disclosure as defined in the claims.

What is claimed is:

1. A rotary actuator comprising:

a rotor having a body and defining a plurality of contact surfaces; and a stator having a body and defining a plurality of inflatable bladders circumferentially spaced about the stator body, the stator positioned relative to the rotor such that upon sequential inflation of the plurality of inflatable bladders, the rotor is caused to rotate, wherein the rotor is configured to rotate 360°, wherein the rotor is positioned internally of the stator, and wherein the body of the internally positioned rotor includes a plurality of ribs that define the plurality of contact surfaces on each side of the ribs such that the internally positioned rotor can be rotated in either direction.

2. The rotary actuator according to claim 1, wherein the body of the internally positioned rotor includes a central axis CA and defines a plurality of wells disposed therebetween the plurality of contact surfaces.

3. The rotary actuator according to claim 1, wherein the body of the internally positioned rotor includes a connector plate disposed at one end thereof.

4. The rotary actuator according to claim 1, wherein the body of the internally positioned rotor includes four ribs such that four contact surfaces are defined in each direction of rotation.

5. The rotary actuator according to claim 1, wherein the rotor is fabricated from 3D printed ABS or cast/assembled layers of Mold Star 30 and a layer of PDMS or any suitable elastomeric material and the stator is fabricated from Ecoflex 50 or any suitable elastomeric material.

6. The rotary actuator according to claim 1, wherein the plurality of inflatable bladders are actuated in sets to sequentially rotate the rotor.

7. The rotary actuator according to claim 1, wherein the plurality of inflatable bladders in each set are equal to the plurality of contact surfaces on the rotor such that each contact surface is contacted by a respective inflatable bladder of the set during a specific actuation.

8. The rotary actuator according to claim 1, wherein the body of the stator is configured to extend about an internal opening that is variably sized to receive the rotor therein.

9. The rotary actuator according to claim 1, wherein each inflatable bladder is configured to be spaced at a step angle $\alpha$ that is dependent on the number of inflatable bladders.

10. The rotary actuator according to claim 1, wherein the body of the stator is sized to be received within a central opening of the rotor.

11. The rotary actuator according to claim 1, wherein the stator is formed in a mold having a central portion configured to define an opening and a plurality of fins configured to define the respective plurality of inflatable bladders, and wherein the plurality of fins are positioned to form the plurality of inflatable bladders proximate a wall of the opening when the stator is positioned externally of the rotor, or wherein the plurality of fins are positioned to form the plurality of inflatable bladders proximate an outer wall of the stator body when the stator is positioned internally of the rotor.

12. The rotary actuator according to claim 1, wherein a pair of rotary actuators is configured for use in a winch device such that the rotor of each actuator is connected to a spindle from which a string extends and fluid tubes are connected to each stator and controlled to cause rotation of the rotor and the spindle.

13. The rotary actuator according to claim 12, wherein forward rotation causes the spindle to lower a grip that is pneumatically controlled through a line and rearward rotation causes the spindle to raise the grip.

14. The rotary actuator according to claim 1, wherein a pair of rotary actuators is configured for use in a two-wheel vehicle such that the two-wheel vehicle includes an elastomeric body having an elastomeric axle on each end with each elastomeric axle configured to support a respective rotary actuator.

15. The rotary actuator according to claim 14, wherein a plurality of fluid tubes are connected to each stator and controlled to cause rotation of each rotor which in turn causes the two-wheel vehicle to move forward or backward.

16. The rotary actuator according to claim 14, wherein a pair of two-wheel vehicles is configured for use in a four-wheel vehicle connected by an elastomeric chassis.

17. The rotary actuator according to claim 16, wherein a plurality of fluid tubes are connected to each stator and controlled to cause rotation of each rotor which in turn causes the four-wheel vehicle to move forward or backward.

18. The rotary actuator according to claim 1, wherein a contact surface of the plurality of contact surfaces is configured to contact more than two bladders.

19. The rotary actuator according to claim 1, wherein an inflatable bladder, in a deflated state, is located on the stator, removed from an internal opening of the stator, and wherein the inflatable bladder is removed from an internal opening of the stator so as to not interfere with the rotation of the rotor caused by an adjacent bladder that is in an inflated state.

20. A method of using a rotary actuator comprising:

providing a rotary actuator including a rotor having a body and defining a plurality of contact surfaces and a stator having a body and defining a plurality of inflatable bladders circumferentially spaced about the stator body, the stator positioned relative to the rotor such that upon sequential inflation of the plurality of inflatable bladders, the rotor is caused to rotate, wherein the plurality of inflatable bladders are actuated in sets to sequentially rotate the rotor, the plurality of inflatable bladders in each set is equal to the plurality of contact surfaces on the rotor such that each contact surface is contacted by a respective inflatable bladder of the set during a specific actuation, and wherein the rotor is configured to rotate 360°, wherein the rotor is positioned internally of the stator, and wherein the body of the internally positioned rotor includes a plurality of ribs that define the plurality of contact surfaces on each side of the ribs such that the internally positioned rotor can be rotated in either direction; and actuating the plurality of inflatable bladders such that they first contact a respective contact surface and expand into a well that is disposed therebetween the contact surface and the body of the rotor and the subsequent inflatable bladder set begins inflation as the previous inflatable bladder set finishes deflation.

21. The method according to claim 20, wherein the rotor is fabricated from 3D printed ABS or cast/assembled layers of Mold Star 30 and a layer of PDMS or any suitable elastomeric material and the stator is fabricated from Ecoflex 50 or any suitable elastomeric material.

22. A rotary actuator comprising:

a rotor having a body and defining a plurality of contact surfaces; and a stator having a body and defining a plurality of inflatable bladders circumferentially spaced about the stator body, the stator positioned relative to the rotor such that upon sequential inflation of the plurality of inflatable bladders, the rotor is caused to rotate, wherein the rotor is configured to rotate 360°, wherein the rotor is positioned externally of the stator, and wherein the body of the externally positioned rotor is disposed between a pair of opposed plates and defines a central opening having a configuration that defines a plurality of wells disposed therebetween the plurality of contact surfaces.

23. The rotary actuator according to claim 22, wherein the plurality of contact surfaces are defined by flat sides of the central opening and the plurality of wells are defined in rounded corners of the central opening.

24. The rotary actuator according to claim 22, wherein the externally positioned rotor includes four contact surfaces that are contacted on opposite ends thereof to achieve rotation in each direction.

25. A method of using a rotary actuator comprising:

providing a rotary actuator including a rotor having a body and defining a plurality of contact surfaces and a stator having a body and defining a plurality of inflatable bladders circumferentially spaced about the stator body, the stator positioned relative to the rotor such that upon sequential inflation of the plurality of inflatable bladders, the rotor is caused to rotate, wherein the plurality of inflatable bladders are actuated in sets to sequentially rotate the rotor, the plurality of inflatable bladders in each set is equal to the plurality of contact surfaces on the rotor such that each contact surface is contacted by a respective inflatable bladder of the set during a specific actuation, wherein the rotor is configured to rotate 360°, wherein the rotor is positioned externally of the stator, and wherein the body of the externally positioned rotor is disposed between a pair of opposed plates and defines a central opening having a configuration that defines a plurality of wells disposed therebetween the plurality of contact surfaces; and actuating the plurality of inflatable bladders such that they first contact a respective contact surface and expand into a well that is disposed therebetween the contact surface and the body of the rotor and the subsequent inflatable bladder set begins inflation as the previous inflatable bladder set finishes deflation.

* * * * *